US009403381B2

(12) United States Patent
Kondo

(10) Patent No.: US 9,403,381 B2
(45) Date of Patent: Aug. 2, 2016

(54) CURL ELIMINATING DEVICE FOR RECORDING MEDIUM AND IMAGE FORMING APPARATUS INCLUDING THE SAME

(71) Applicant: KYOCERA Document Solutions Inc., Osaka (JP)

(72) Inventor: Kazuhisa Kondo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/816,788

(22) Filed: Aug. 3, 2015

(65) Prior Publication Data

US 2016/0052301 A1 Feb. 25, 2016

(30) Foreign Application Priority Data

Aug. 19, 2014 (JP) ..... 2014-166719

(51) Int. Cl.
*B41J 11/00* (2006.01)
*B65H 5/00* (2006.01)

(52) U.S. Cl.
CPC ..... *B41J 11/0005* (2013.01); *B65H 5/00* (2013.01)

(58) Field of Classification Search
CPC .. B41J 11/0005; B41J 11/04; G03G 15/6576; G03G 2215/00662; G03G 15/235; B65H 23/34
USPC ..... 347/104, 16, 101
See application file for complete search history.

(56) References Cited

U.S. PATENT DOCUMENTS

| | | | | |
|---|---|---|---|---|
| 6,314,268 | B1 | 11/2001 | Giunta et al. | 399/406 |
| 2004/0042831 | A1 * | 3/2004 | Burnett et al. | 399/406 |
| 2012/0212552 | A1 * | 8/2012 | Houjou et al. | 347/101 |

FOREIGN PATENT DOCUMENTS

| | | | |
|---|---|---|---|
| JP | 4-338059 | A | 11/1992 |
| JP | 2002-160862 | A | 6/2002 |
| JP | 2009-208937 | A | 9/2009 |

* cited by examiner

*Primary Examiner* — Henok Legesse
(74) *Attorney, Agent, or Firm* — Stein IP, LLC

(57) ABSTRACT

A curl eliminating device includes a decurl roller pair including a first roller and a second roller pressed to contact with an outer circumference surface of the first roller so as to correct curl of a recording medium, a cleaning member for cleaning the second roller, and a pressure contact mechanism. The first roller is an elastic roller including an elastic layer formed on the outer circumference surface and contacts with a non-image formed side of the recording medium. The second roller is a roller having a smaller diameter than the first roller and higher hardness than the first roller, and contacts with an image formed side of the recording medium. The pressure contact mechanism presses the cleaning member to contact with an outer circumference surface of the second roller from the side opposite to the first roller.

8 Claims, 7 Drawing Sheets

CURL ELIMINATING DEVICE FOR RECORDING MEDIUM AND IMAGE FORMING APPARATUS INCLUDING THE SAME

INCORPORATION BY REFERENCE

This application is based upon and claims the benefit of priority from the corresponding Japanese Patent Application No. 2014-166719 filed Aug. 19, 2014, the entire contents of which are hereby incorporated by reference.

BACKGROUND

The present disclosure relates to a curl eliminating device for eliminating a curl of a recording medium such as a paper sheet and to an image forming apparatus including the curl eliminating device.

Conventionally, in an electrophotographic type or an inkjet recording type image forming apparatus such as a copier or a printer, a double-sided printing method is widely used, in which the paper sheet after forming an image on one side of the paper sheet is not discharged but is conveyed again to an image forming unit so that an image is formed on the other side too. The double-sided printing type image forming apparatus is equipped with a double-sided circulation transport path for reversing the paper sheet after an image is formed on one side thereof, so as to reconvey the reversed paper sheet to the image forming unit.

As to the image forming apparatus of the double-sided printing type described above, it is common to switch back the paper sheet in the double-sided circulation transport path, to stop the paper sheet temporarily on a reverse tray, and then to reconvey the paper sheet from the rear end so that the front and back sides of the paper sheet are reversed. For this reason, when the paper sheet passes through the double-sided circulation transport path having a U-shaped curve, a curl (curling) may occur to the paper sheet. Main causes of the curl include contraction of a resin component in toner due to thermal fixing in an electrophotographic image forming apparatus, swelling of the paper sheet due to impregnation of ink in an inkjet image forming apparatus, and a moisture control function of the paper sheet depending on temperature and humidity conditions.

For instance, when continuously printing on both sides of the paper sheets, in order to improve print efficiency, during printing on a second side, the next paper sheet having the first side printed is set on standby in the double-sided circulation transport path. In this case, curl may occur to the paper sheet stopped at a bent part of the double-sided circulation transport path. In particular, as need for bookbinding by on-demand printing has been increased, frequency of using thick paper sheets having basis weight of 300 g/m$^2$ as cover papers of booklets has been increased. Such thick paper sheets tend to occur curls, which is hardly straightened.

Accordingly, there are proposed various curl eliminating devices for eliminating curl of a paper sheet. For instance, there is known a curl correction device for correcting curl of a paper sheet by making the paper sheet pass through a nip portion between a pressure roller and a belt. It is also known to adjust pressing amount of the pressure roller to the belt by using a cam.

In addition, there is known a curl eliminating device in which first and third rollers as compressive soft rollers are pressed to contact with both sides of a second roller as a non-compressive hard roller, and a nip portion for the sheet to pass through is determined in accordance with direction of the curl of the sheet.

Further, there is known a decurl device including a decurl part capable of moving in the direction perpendicular to the conveying direction of continuous paper, in which the decurl part is moved opposite to the curl direction of the continuous paper so that a curled part is straightened by a decurl bar for removing the curl.

SUMMARY

A curl eliminating device according to one aspect of the present disclosure includes a decurl roller pair, a cleaning member, and a pressure contact mechanism. The decurl roller pair includes a first roller contacting with a non-image formed side of a recording medium and a second roller configured to be pressed to contact with an outer circumference surface of the first roller and configured to contact with an image formed side of the recording medium, so as to correct a curl of the recording medium. The first roller is an elastic roller including an elastic layer formed on the outer circumference surface, and the second roller is a roller having a diameter smaller than that of the first roller and hardness higher than that of the first roller. The cleaning member cleans the second roller. The pressure contact mechanism presses the cleaning member to contact with an outer circumference surface of the second roller from the side opposite to the first roller.

Further features and advantages of the present disclosure will become apparent from the description of embodiments given below.

DETAILED DESCRIPTION

Figure 1:
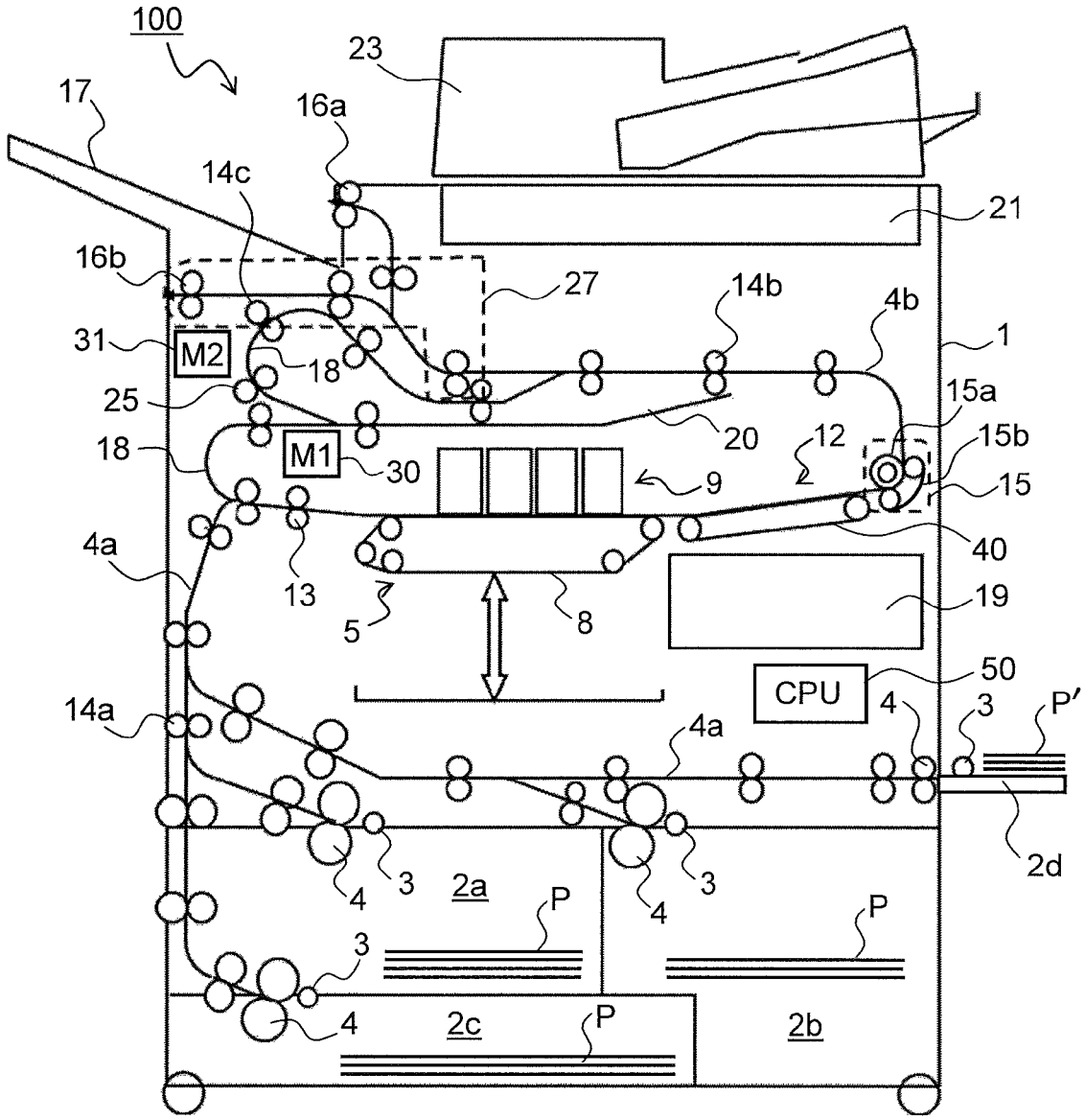
FIG. 1 is a diagram showing an internal structure of an inkjet type multifunction peripheral as an example of an image forming apparatus equipped with a curl eliminating device of the present disclosure.

Now, embodiments of the present disclosure are described with reference to the drawings. FIG. 1 is a side cross-sectional view indicating an internal structure of an inkjet type multifunction peripheral 100 equipped with a curl eliminating device 25 of the present disclosure.

As shown in FIG. 1, the multifunction peripheral 100 includes sheet feed cassettes 2*a* to 2*c* as paper sheet storing units disposed in a lower part inside a multifunction peripheral main body 1. Inside the sheet feed cassettes 2*a* to 2*c*, there are stacked and stored paper sheets P as cut paper sheets before printing as an example of recording medium. A sheet feeding device including a pickup roller 3 and a sheet feed roller pair 4 is disposed on the downstream side in the paper sheet conveying direction of each of the sheet feed cassettes 2*a* to 2*c*, for example on the upper left side of the sheet feed cassette 2*a* in FIG. 1. This sheet feeding device separates the paper sheets P one by one and sends out the paper sheet P toward the upper left of the sheet feed cassettes 2*a* to 2*c* in FIG. 1. The sheet feed cassettes 2*a* to 2*c* can be drawn out horizontally from the front side of the multifunction peripheral main body 1 so as to supply the paper sheets P.

A manual sheet supply tray 2*d* is disposed on the outer right side of the multifunction peripheral main body 1. Paper sheets P' of a size different from that of the paper sheets P in the sheet feed cassettes 2*a* to 2*c*, or paper sheets P' such as envelops that are difficult to pass through a bent conveying path, or paper sheets P' to be set manually one by one, or the like are set on the manual sheet supply tray 2*d*. A sheet feeding device including a pickup roller 3 and a sheet feed roller pair 4 is disposed on the downstream side in the paper sheet conveying direction of the manual sheet supply tray 2*d*, namely on the left side of the manual sheet supply tray 2*d* in FIG. 1. This sheet feeding device separates the paper sheets P' on the manual sheet supply tray 2*d* one by one and sends out the paper sheet P' toward the left in FIG. 1.

In addition, a first paper sheet transport path 4*a* is disposed inside the multifunction peripheral 100. The paper sheet P sent out from one of the sheet feed cassettes 2*a* to 2*c* is conveyed in the first paper sheet transport path 4*a* upward vertically along the left side surface of the multifunction peripheral main body 1. On the other hand, the paper sheet P' sent out from the manual sheet supply tray 2*d* is conveyed in the first paper sheet transport path 4*a* in a substantially horizontal left direction, and then is conveyed upward vertically along the left side surface of the multifunction peripheral main body 1.

A registration roller pair 13 is disposed at a downstream end of the first paper sheet transport path 4*a* in the paper sheet conveying direction. Further, a first belt conveying unit 5 and a printing unit 9 are disposed near the downstream side of the registration roller pair 13. The paper sheet P sent from one of the sheet feed cassettes 2*a* to 2*c* (or the paper sheet P' sent from the manual sheet supply tray 2*d*) passes in the first paper sheet transport path 4*a* and reaches the registration roller pair 13. The registration roller pair 13 corrects skew of the paper sheet P or P' and sends out the paper sheet P or P' to the first belt conveying unit 5 in synchronization with timing of ink discharge operation performed by the printing unit 9. Note that conveying roller pairs 14*a* for conveying the paper sheet P or P' are disposed at appropriate positions in the first paper sheet transport path 4*a*.

The first belt conveying unit 5 includes an endless first conveying belt 8 wound around a plurality of rollers including a drive roller. The first conveying belt 8 is driven by the drive roller to turn in a clockwise direction in FIG. 1. Inside the first conveying belt 8, at a position corresponding to the backside of the conveying surface (upper surface) of the first conveying belt 8, there is disposed a paper sheet suction unit (not shown). The paper sheet suction unit has many holes for sucking air on the upper surface and includes a fan inside, so as to suck air downward from the upper surface. In addition, the first conveying belt 8 also has many air holes (not shown) for sucking air. With the structure described above, the first belt conveying unit 5 sucks and holds the paper sheet P or P' on the conveying surface of the first conveying belt 8 so as to convey the paper sheet P or P'.

The paper sheet P sent by the registration roller pair 13 is sucked and held on the conveying surface (upper surface in FIG. 1) of the first conveying belt 8 and is conveyed from left to right in FIG. 1. The first belt conveying unit 5 can move in the up and down direction in the multifunction peripheral main body 1.

The printing unit 9 includes line heads for printing an image on the paper sheet P sucked and held on the conveying surface of the first conveying belt 8 so as to be conveyed. In accordance with image data received from an external computer or the like, each of the line heads sequentially discharges corresponding ink toward the paper sheet P or P' sucked by the first conveying belt 8, and hence a full color image is printed on the paper sheet P or P' as an overlaid image of yellow, magenta, cyan, and black inks.

A second belt conveying unit 12 is disposed on the downstream side (right side in FIG. 1) of the first belt conveying unit 5 in the paper sheet conveying direction. The paper sheet P or P' on which an ink image is printed by the printing unit 9 is sent to the second belt conveying unit 12, and the ink on the surface of the paper sheet P or P' is dried while the paper sheet P or P' passes through the second belt conveying unit 12.

The second belt conveying unit 12 includes an endless second conveying belt 40 wound around a plurality of rollers including a drive roller. The second conveying belt 40 is driven by the drive roller to turn in the clockwise direction in FIG. 1. The paper sheet P or P' is sucked and held on the conveying surface (upper surface) of the second conveying belt 40 by the same mechanism as the first conveying belt 8. After the printing unit 9 prints an image on the paper sheet P, the paper sheet P is conveyed by the first belt conveying unit 5 to the right direction and received by the second conveying belt 40, and then is conveyed to a diagonally upper right direction in FIG. 1.

A decurl part 15 is disposed on the downstream side of the second belt conveying unit 12 in the paper sheet conveying direction near the right side surface of the multifunction peripheral main body 1. The decurl part 15 includes a particle roller 15*a* that has an outer circumference surface on which many particles are attached and contacts with a printed surface of the paper sheet P or P', and an endless belt 15*b* that is stretched around two support rollers and has a surface coated with Teflon (trademark). When the endless belt 15*b* is driven to turn by the common drive source shared by the second belt conveying unit 12, the particle roller 15*a* pressed to contact with the endless belt 15*b* rotates following the endless belt 15*b*. The paper sheet P or P' after the ink is dried by the second belt conveying unit 12 is sent to the decurl part 15 in which curl (curling) is corrected.

A second paper sheet transport path 4*b* is disposed on the downstream side (upper side in FIG. 1) of the decurl part 15 in the paper sheet conveying direction. When double-sided printing is not performed, the paper sheet P or P' after passing through the decurl part 15 is discharged from the second paper sheet transport path 4*b* via a discharge roller pair 16*a* onto a paper sheet discharge tray 17 disposed on the upper left of the multifunction peripheral 100, or is conveyed from the second paper sheet transport path 4*b* via a discharge roller pair 16*b* into a paper sheet post processing device (not shown) connected to the left outside surface of the multifunction peripheral 100.

In addition, a maintenance unit 19 is disposed below the second belt conveying unit 12. When performing purge action to discharge ink in the nozzles having high viscosity from the ink discharge nozzles, the first belt conveying unit 5 is moved downward, and then the maintenance unit 19 is moved to between the printing unit 9 and the first belt conveying unit 5.

The maintenance unit 19 after moving to below the printing unit 9 wipes off the ink discharged from the ink discharge nozzles of the print head and collects the wiped-off ink.

An image reader unit 21 is disposed in the uppermost part in the multifunction peripheral main body 1. The image reader unit 21 includes a scanning optical system including a scanner lamp for illuminating a document in copy operation and a mirror for changing an optical path of reflection light from the document, a condenser lens for condensing the reflection light from the document so as to form an image, and a CCD sensor for converting the formed image light into an electric signal, and the like (all of which are not shown). The image reader unit 21 reads the document image so as to convert it into image data. A document feeder device 23 for automatically feeding document sheets to the image reader unit 21 is disposed on the upper surface of the multifunction peripheral main body 1.

A double-sided circulation transport path 18 for performing double-sided printing on the paper sheet P or P' is disposed above the printing unit 9 in the upper part of the multifunction peripheral main body 1. When performing the double-sided printing, after printing on a first side of the paper sheet P is finished, the paper sheet P passes through the second belt conveying unit 12 and the decurl part 15, and then passes in the second paper sheet transport path 4*b* so as to be sent to the double-sided circulation transport path 18. After the paper sheet P or P' is sent to the double-sided circulation transport path 18, the conveying direction of the paper sheet P or P' is switched in a reverse tray 20 for printing on a second side so that the paper sheet P or P' passes above the printing unit 9 and is sent to the left side. Then, the paper sheet P or P' is sent via the first paper sheet transport path 4*a* and the registration roller pair 13 to the first belt conveying unit 5 again in the state where the second side faces upward. Further, similarly to the first paper sheet transport path 4*a*, there are disposed conveying roller pairs 14*b* and 14*c* for conveying the paper sheet P or P' at appropriate positions in the second paper sheet transport path 4*b* and the double-sided circulation transport path 18. The conveying roller pair 14*c* disposed in the double-sided circulation transport path 18 is driven to rotate by a first motor 30. As the first motor 30, a stepping motor is used, which facilitates adjustment of the rotation speed of the conveying roller pair 14*c*.

In addition, the double-sided circulation transport path 18 can also have a function of making the next paper sheet P or P' wait on standby when continuously printing on both sides of the paper sheet P or P'. By making the paper sheet P or P' wait on standby in the double-sided circulation transport path 18 and controlling the rotation drive of the first motor 30, the paper sheet P or P' is accelerated, decelerated, or stopped, so that an interval between paper sheets when performing the double-sided printing can be decreased. Thus, image forming efficiency can be improved.

Because the printed side (printed surface) of the paper sheet P or P' is swelled with the ink after printing on one side thereof by the printing unit 9, the paper sheet P or P' is curled with convex side of the printed side. In particular, when using water based ink having small permeability in the paper sheet P or P', the ink is apt to stay on the printed side so that occurrence of curl becomes outstanding. When the curled paper sheet P or P' is conveyed via the reverse tray 20 and the registration roller pair 13 to the printing unit 9 again, the paper sheet P or P' may be insufficiently sucked and held by the first belt conveying unit 5, or the distance to the print head of the printing unit 9 may vary so that poor quality of printing may occur.

Accordingly, there is disposed the curl eliminating device 25 in the double-sided circulation transport path 18 so as to correct the curl of the paper sheet P or P'. The curl eliminating device 25 is disposed near the upstream side of the reverse tray 20 in the paper sheet conveying direction so as to avoid a stop position of the paper sheet P or P' when continuously printing on both sides of the paper sheet P or P'.

Further, in the multifunction peripheral 100, there is disposed a control unit (CPU) 50 for controlling operations of the rollers, the printing unit 9, the first belt conveying unit 5, the second belt conveying unit 12, the maintenance unit 19, and the like described above.

Figure 2:
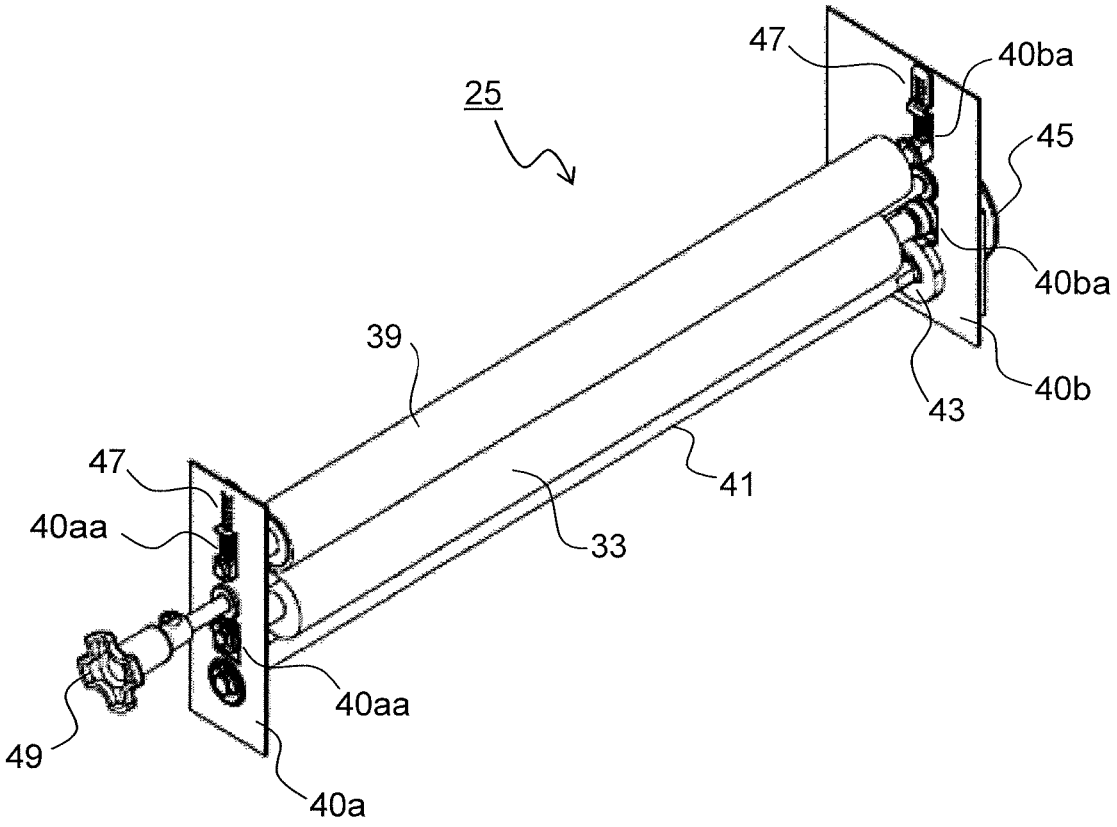
FIG. 2 is a diagram showing the curl eliminating device according to a first embodiment of the present disclosure.
Figure 3:
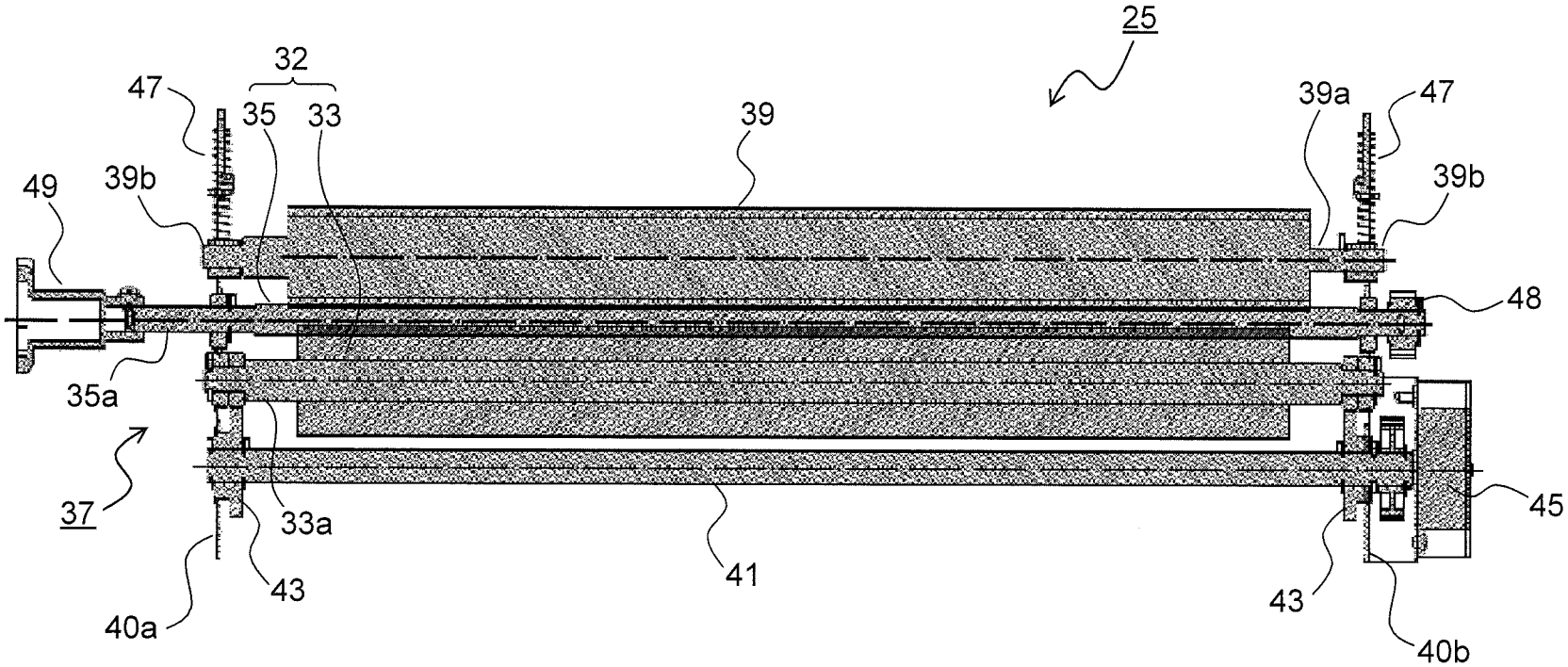
FIG. 3 is a cross-sectional view of a decurl roller pair and a cleaning roller taken along the axial direction thereof, which constitute the curl eliminating device of the first embodiment.

FIG. 2 is a diagram showing a structure of the curl eliminating device 25 according to a first embodiment of the present disclosure, and FIG. 3 is a cross-sectional view of a decurl roller pair 32 and a cleaning roller 39 as a cleaning member of the curl eliminating device 25 taken along the axial direction thereof. The decurl roller pair 32 includes a first roller 33 having an elastic layer and a second roller 35 (not shown in FIG. 2) having higher hardness than that of the first roller 33.

In order to enhance a curl correction effect by the decurl roller pair 32, it is necessary that the diameter of the second roller 35 as a hard roller is as small as possible (e.g., 8 mm or smaller). A metal roller having a diameter of 7 mm, for example, is used as the second roller 35. On the other hand, as the first roller 33, an elastic roller is used, for example, which includes an elastic layer made of foamed silicone rubber formed on the outer circumference surface of a rotation shaft 33*a* and has a diameter of 24.2 mm.

A rotation shaft 35*a* of the second roller 35 is supported by frames 40*a* and 40*b* in the front and rear direction of the multifunction peripheral 100 via bearings in a rotatable manner. In addition, the rotation shaft 33*a* of the first roller 33 is supported by the frames 40*a* and 40*b* via bearings in a rotatable manner and is supported in a slidable manner along slots 40*aa* and 40*ba* formed in the frames 40*a* and 40*b*. The first roller 33 and the second roller 35 are pressed to contact with each other at a predetermined pressure by a pressure adjustment mechanism 37 as described later.

The cleaning roller 39 is pressed to contact with the second roller 35 contacting with the printed surface of the paper sheet, from the side opposite to the nip portion with the first roller 33. The cleaning roller 39 is a felt roller including felt (nonwoven fabric) wound around an outer circumference surface of a roller body or an elastic roller having a surface made of a porous elastic material. The cleaning roller 39 rotates following the second roller 35 so as to wipe off ink attached to the second roller 35. A rotation shaft 39*a* of the cleaning roller 39 is supported by the frames 40*a* and 40*b* via bearing in a rotatable manner and is supported in a slidable manner along the slots 40*aa* and 40*ba* formed in the frames 40*a* and 40*b*.

In addition, a compression springs 47 (pressure contact mechanism) for pressing bearing portions 39*b* provided to both end portions of the rotation shaft 39*a* in a downward direction (toward the second roller 35). The cleaning roller 39 is pressed by the compression springs 47 to contact with the second roller 35 at a predetermined pressure. As a drive source for driving the second roller 35 of the decurl roller pair 32 to rotate, a second motor 31 (see FIG. 1) is used, which is different from the first motor 30 as a drive source of the conveying roller pair 14*c*. As the second motor 31, a DC brushless motor is used, which is suitable for use at a high rotational frequency and a high torque.

The second motor 31 for driving the decurl roller pair 32 also drives a discharging unit 27 including the discharge roller pair 16*b*. In other words, the single second motor 31 works as both the drive sources for the decurl roller pair 32 and the discharging unit 27. In this way, it is not necessary to dispose a dedicated motor for driving the discharging unit 27 so that the number of motors and a space for disposing the motors can be reduced. Thus, it is possible to contribute to downsizing and cost reduction of the multifunction peripheral 100.

Further, a drive force is input from the second motor 31 to a drive input gear 48 fixed to an end of the rotation shaft 35*a* of the second roller 35. In this way, the second roller 35 rotates, and the first roller 33 and the cleaning roller 39 rotate following the second roller 35. The decurl roller pair 32 is disposed to cover a substantially entire region in the paper sheet width direction (perpendicular to the paper plane of FIGS. 2 and 3). When the paper sheet P or P' passes through the nip portion of the decurl roller pair 32, curl (curing) of the paper sheet is corrected. In addition, a jamming disposal handle 49 is disposed on the other end (opposite to the drive input gear 48) of the rotation shaft 35*a* of the second roller 35. When jamming of the paper sheet P or P' occurs on the decurl roller pair 32, the second roller 35 is manually rotated by grasping the jamming disposal handle 49 so as to deal with the jamming.

Figure 4:
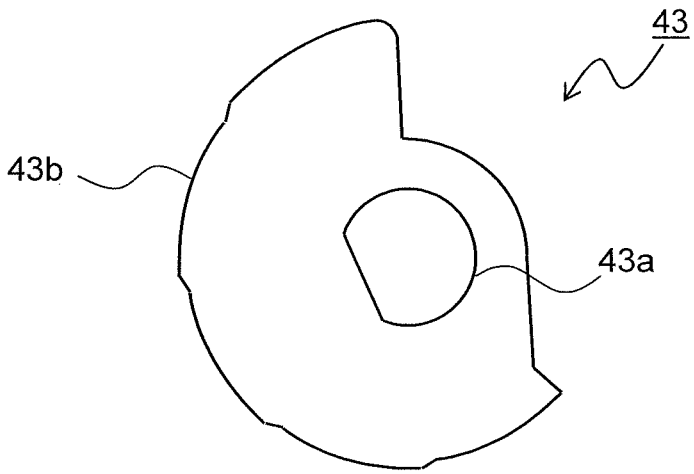
FIG. 4 is a diagram showing of an eccentric cam used for a pressure adjustment mechanism of the curl eliminating device.

The pressure adjustment mechanism 37 includes eccentric cams 43 fixed to both ends of a cam shaft 41 and a pressure adjustment motor 45 for rotating the cam shaft 41. FIG. 4 is a diagram showing the eccentric cam 43 that is used for the pressure adjustment mechanism 37 of the curl eliminating device 25. The eccentric cam 43 has a D-shaped shaft hole 43*a* in which the cam shaft 41 is inserted and fixed and an outer circumference surface 43*b* having a varying distance from the center of the shaft hole 43*a*. The outer circumference surface 43*b* of the eccentric cam 43 contacts with the bearing portion of the rotation shaft 33*a* of the first roller 33. When the eccentric cams 43 are rotated by the pressure adjustment motor 45, a position of the rotation shaft 33*a* of the first roller 33 with respect to the rotation shaft 35*a* of the second roller 35 (an intershaft distance) is adjusted.

A contact pressure between the first roller 33 and the second roller 35 necessary for correcting curl is different depending on a thickness of the paper sheet. Accordingly, it is preferred that the control unit 50 (see FIG. 1) sets the contact pressure between the first roller 33 and the second roller 35 to an appropriate value on the basis of thickness information of the paper sheet input from a host device such as a personal computer or from an operation panel (not shown). Specifically, the control unit 50 transmits a control signal based on the thickness information of the paper sheet to the pressure adjustment motor 45. The control unit 50 controls the eccentric cams 43 to rotate by a predetermined amount for adjusting the intershaft distance between the rotation shaft 33*a* and the rotation shaft 35*a*, so that the contact pressure between the first roller 33 and the second roller 35 becomes a set value corresponding to the thickness of the paper sheet P or P'.

As described above, it is necessary to use a hard roller having a small diameter as the second roller 35 constituting the decurl roller pair 32. For this reason, the second roller 35 may be warped by a strong press contact force acting between the first roller 33 and the second roller 35. When a warp occurs to the second roller 35, the decurl roller pair 32 becomes misaligned, and hence a wrinkle occurs on the paper sheet P or P' passing through the nip portion of the decurl roller pair 32, or a curl correction amount in the axial direction by the decurl roller pair 32 becomes uneven. As a result, image quality may be deteriorated.

Accordingly, in this embodiment, the cleaning roller 39 for cleaning the second roller 35 is disposed on the side opposite to the first roller 33 with respect to the second roller 35. With this structure, opposed portions on the outer circumference surface of the second roller 35 are sandwiched between the first roller 33 and the cleaning roller 39. As a result, the press contact force acting from the first roller 33 to the second roller 35 by the pressure adjustment mechanism 37 and the press contact force acting from the cleaning roller 39 to the second roller 35 by the compression spring 47 are canceled by each other, so that the warp of the second roller 35 can be suppressed.

Accordingly, ink attached to the outer circumference surface of the second roller 35 is removed by the cleaning roller 39 so that dirt (offset) on the image surface is suppressed, and occurrence of wrinkle on the paper sheet P or P', or the unevenness of the curl correction amount due to the warp of the second roller 35 can be also suppressed.

Figure 5:
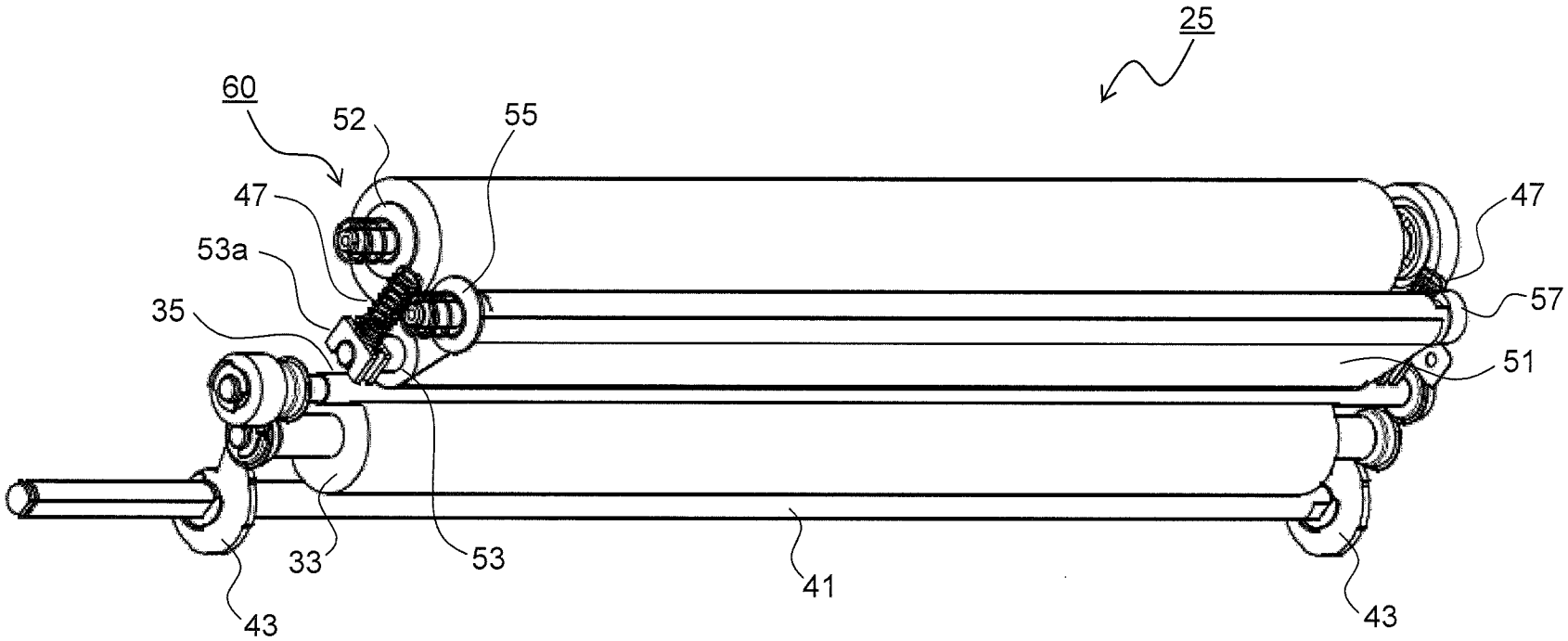
FIG. 5 is a diagram of the curl eliminating device viewed from diagonally above on an upstream side in a conveying direction according to a second embodiment of the present disclosure.
Figure 6:
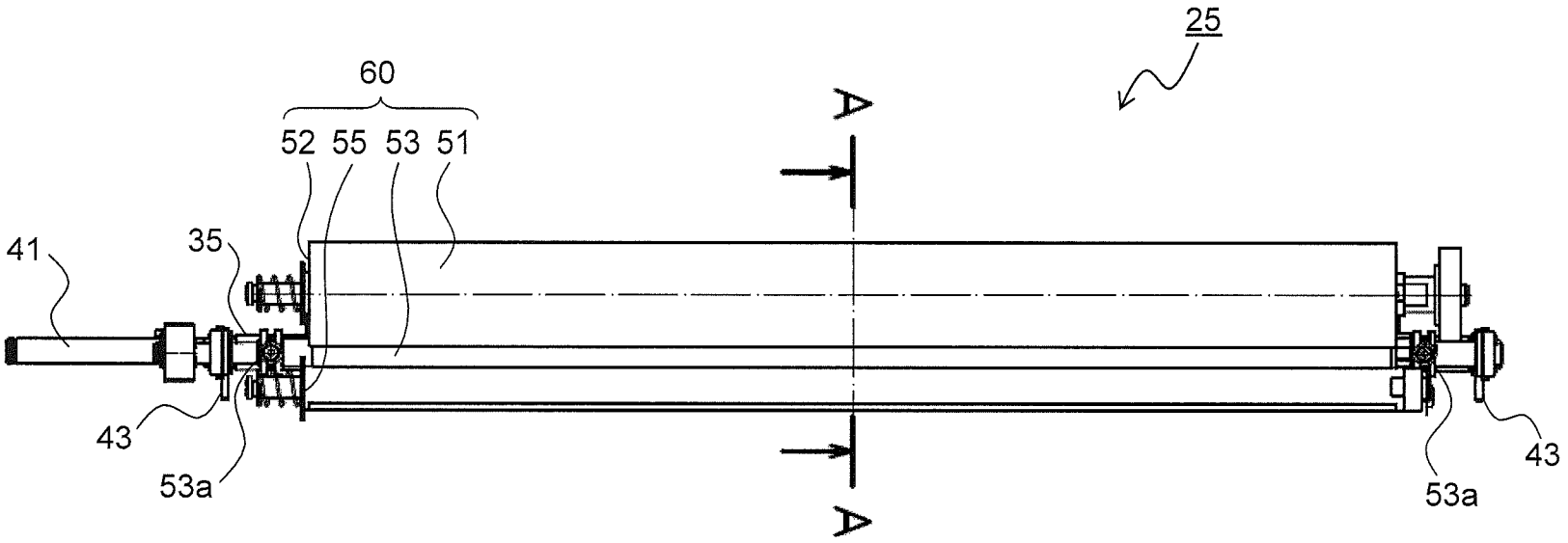
FIG. 6 is a diagram of the curl eliminating device viewed from above according to the second embodiment.
Figure 7:
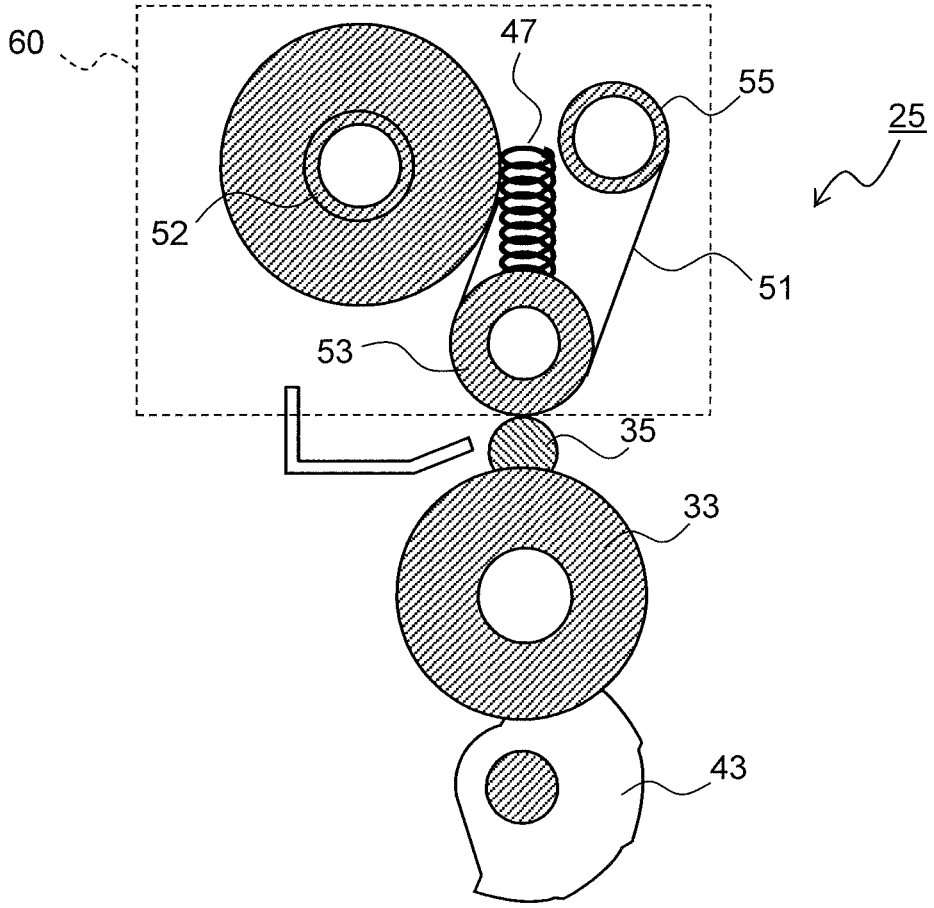
FIG. 7 is a cross-sectional view of the curl eliminating device taken along a plane perpendicular to the axial direction according to the second embodiment.

FIG. 5 is a diagram of the curl eliminating device 25 according to a second embodiment of the present disclosure viewed from diagonally above the conveying direction upstream side, FIG. 6 is a diagram of the curl eliminating device 25 of the second embodiment viewed from above, and FIG. 7 is a cross-sectional view of the curl eliminating device 25 of the second embodiment taken along a plane perpendicular to the axial direction (taken along the line AA' in FIG. 6). In this embodiment, as the cleaning member for cleaning the second roller 35, a web device 60 including a fiber web 51, a sending-out roller 52, a pressure roller 53, and a winding roller 55 is provided instead of the cleaning roller 39. The pressure adjustment mechanism 37 including the eccentric cams 43 fixed to both ends of the cam shaft 41 and the pressure adjustment motor 45 (see FIG. 3) for driving the cam shaft 41 to rotate is the same as in the first embodiment.

The fiber web 51 is wound around the sending-out roller 52 like a roll, and the fiber web 51 sent out from the sending-out roller 52 is pressed by the pressure roller 53 to contact with the second roller 35, and then is wound around the winding roller 55. The pressure roller 53 is a metal roller having a high stiffness and a diameter of 10 mm or larger. The compression springs 47 (pressure contact mechanism) for pressing a bearing portion 53*a* in a downward direction (toward the second roller 35) is disposed on each end portion of the rotation shaft of the pressure roller 53. The pressure roller 53 is pressed by the compression springs 47 to contact with the second roller 35 at a predetermined press contact force.

A drive input gear 57 is attached to the rotation shaft of the winding roller 55. When a rotation drive force is transmitted to the drive input gear 57 from a drive source (not shown), the sending-out roller 52 and the winding roller 55 rotate at a line speed of approximately 1% of that of the second roller 35. In addition, the pressure roller 53 rotates following the fiber web 51 that is moved by the rotations of the sending-out roller 52 and the winding roller 55.

In this way, the fiber web 51 rubs the outer circumference surface of the second roller 35 so as to remove the ink attached to the outer circumference surface of the second roller 35. In addition, when the fiber web 51 is gradually sent out from the sending-out roller 52, a new part to which no ink is attached contacts with the second roller 35, while the part to which ink is attached is wound around the winding roller 55. Accordingly, there is no possibility that ink attached to the fiber web 51 is transferred to the second roller 35.

Further, in this embodiment, the pressure roller 53 for pressing the fiber web 51 to the second roller 35 is disposed on the side opposite to the first roller 33 with respect to the second roller 35.

With this structure, opposed portions on the outer circumference surface of the second roller 35 are sandwiched between the first roller 33 and the pressure roller 53. As a result, the press contact force acting from the first roller 33 to the second roller 35 by the pressure adjustment mechanism 37 and the press contact force acting from the pressure roller 53 to the second roller 35 by the compression springs 47 are canceled by each other, so that the warp of the second roller 35 can be suppressed similarly to the first embodiment.

Accordingly, ink attached to the outer circumference surface of the second roller 35 is removed by the fiber web 51 so that dirt (offset) on the image surface is suppressed, and occurrence of wrinkle on the paper sheet P or P', or unevenness of the curl correction amount due to a warp of the second roller 35 can be also suppressed.

Other than that, the present disclosure is not limited to the embodiments described above and can be variously modified within the scope of the spirit of the present disclosure. For instance, the second motor 31 as a drive source for the discharging unit 27 also works as a drive source for the decurl roller pair 32 in the embodiments described above, but it is possible to configure that the second motor 31 is a dedicated drive source for the decurl roller pair 32.

In addition, the inkjet printing type multifunction peripheral 100 equipped with the curl eliminating device 25 is exemplified in the embodiments described above, but the curl eliminating device of the present disclosure can be applied not only to the inkjet printing type but also to other types of image forming apparatus such as an electrophotographic copier, printer, multifunction peripheral, or facsimile.

The present disclosure can be applied to a curl eliminating device that uses the decurl roller pair for correcting curl of a recording medium. By using the present disclosure, it is possible to provide a curl eliminating device having a simple structure that can suppress occurrence of offset due to dirt on the decurl roller pair and can improve a curl removing effect, and an image forming apparatus including the curl eliminating device.

What is claimed is:

1. A curl eliminating device, comprising:

a decurl roller pair including a first roller contacting with a non-image formed side of a recording medium, the first roller being an elastic roller including an elastic layer formed on an outer circumference surface thereof, and a second roller configured to be pressed to contact with the outer circumference surface of the first roller and configured to contact with an image formed side of the recording medium, the second roller having a diameter smaller than that of the first roller and hardness higher than that of the first roller, the decurl roller pair configured to correct curl of the recording medium;

a cleaning member for cleaning the second roller by contacting with the second roller from a side thereof opposite to a nip portion between the first and second rollers;

a pair of frames rotatably supporting both end portions of rotation shafts of the first roller, the second roller, and the cleaning member;

a pressure contact mechanism for pressing the cleaning member to contact with an outer circumference surface of the second roller from the side opposite to the first roller; and a pressure adjustment mechanism for adjusting an interval between the rotation shafts of the first roller and the second roller, wherein the rotation shafts of the first roller and the cleaning member are supported so as to be slidable in a direction toward or away from the second roller along slots formed in the frames, and a press contact force acting from the first roller to the second roller by the pressure adjustment mechanism and a press contact force acting from the cleaning member to the second roller by the pressure adjustment mechanism cancel each other.

2. The curl eliminating device according to claim 1, wherein the cleaning member is a cleaning roller including nonwoven fabric wound around an outer circumference surface of a roller body or a cleaning roller having a surface made of a porous elastic material.

3. The curl eliminating device according to claim 2, wherein a drive input gear to which a drive force is input from a drive source is fixed to one end of the rotation shaft of the second roller, and the first roller and the cleaning roller are driven by the second roller.

4. The curl eliminating device according to claim 3, wherein a handle for manually rotating the second roller is provided to the other end of the rotation shaft of the second roller.

5. The curl eliminating device according to claim 1, wherein the pressure adjustment mechanism adjusts the interval between the rotation shafts of the first roller and the second roller on the basis of thickness information of the recording medium.

6. The curl eliminating device according to claim 5, wherein the pressure adjustment mechanism includes a cam shaft parallel to the rotation shaft of the first roller, an eccentric cam that is fixed to each end of the cam shaft and has an outer circumference surface contacting with a bearing portion of the rotation shaft of the first roller, and a pressure adjustment motor for rotating the cam shaft, so as to adjust an intershaft distance between the rotation shaft of the second roller and the rotation shaft of the first roller by rotating the eccentric cam by a predetermined amount.

7. An image forming apparatus comprising:

the curl eliminating device according to claim 1; and an image forming unit disposed on an upstream side of the curl eliminating device in a recording medium conveying direction so as to form an image on the recording medium.

8. The image forming apparatus according to claim 7, wherein the image forming unit is an inkjet printing unit configured to discharge liquid ink to form the image on the recording medium.

* * * * *